United States Patent [19]

Kotecki et al.

[11] Patent Number: 4,821,154

[45] Date of Patent: Apr. 11, 1989

[54] MULTI-BULB LIGHT SOURCE

[75] Inventors: Ireneusz J. Kotecki; Slawomir Patocki, both of Nepean, Canada

[73] Assignee: Trio Engineering Inc., Nepean, Canada

[21] Appl. No.: 101,785

[22] Filed: Sep. 28, 1987

[51] Int. Cl.[4] ..... F21V 19/04

[52] U.S. Cl. ..... 362/20; 362/211; 362/212; 362/215; 362/347

[58] Field of Search ..... 362/20, 211, 212, 215, 362/347; 246/473 R

[56] References Cited

U.S. PATENT DOCUMENTS

| | | | |
|---|---|---|---|
| 2,032,515 | 3/1936 | Troup | 362/20 |
| 2,258,575 | 10/1941 | MacKay | 362/20 |
| 2,342,085 | 2/1944 | MacKay | 362/20 |
| 2,551,029 | 5/1951 | MacKay | 362/20 |
| 2,557,531 | 6/1951 | Blanchet | 362/20 |
| 4,225,901 | 9/1980 | Luce | 362/20 |
| 4,402,038 | 8/1983 | Hartung et al. | 362/20 |
| 4,415,951 | 11/1983 | Recane et al. | 362/20 |

FOREIGN PATENT DOCUMENTS

| | | | |
|---|---|---|---|
| 0031211 | 7/1981 | European Pat. Off. | 362/347 |
| 3527828 | 3/1987 | Fed. Rep. of Germany | 246/473 R |
| 373052 | 5/1932 | United Kingdom | 362/20 |
| 937394 | 9/1963 | United Kingdom | 362/211 |

*Primary Examiner*—Ira S. Lazarus
*Assistant Examiner*—Sue Hagarman

[57] ABSTRACT

A light source for use in traffic signals has a plurality of light bulbs, in which each bulb is used in turn until it burns out, at which time power is switched to an operable bulb. By means of lenses and mirrors in the light source, a substantially identical pattern of light rays is produced regardless of which bulb is lit.

14 Claims, 12 Drawing Sheets

MULTI-BULB LIGHT SOURCE

FIELD OF THE INVENTION

The invention relates to an optical device for use in light signals. More particularly, it relates to a light source having a plurality of light bulbs, in which each bulb is used in turn until it burns out, when power is switched to an operable bulb. The light source produces a substantially identical pattern of light rays regardless of which bulb is lit.

BACKGROUND OF THE INVENTION

Traffic control signals are employed for the control of both road and rail traffic. Normally, each light signal has a single light bulb as its light source, and when the bulb becomes inoperable, i.e. burns out, the signal no longer works. Frequent maintenance is required to replace the light bulb.

Traffic signals must be bright and oriented correctly, particularly for railway use. Railway signals must be oriented in precise alignment with the track direction, in order to be visible from a great distance. The light source within the signal must be properly positioned in relation to the lens system and colour filters in order to produce a signal with a uniform and properly oriented beam of light.

Attempts have been made in the past to satisfy these two objectives, viz., to produce the increased reliability achieved by having more than one light bulb in the signal, while at the same time correctly aligning the light bulb within the signal. Devices have been made providing electro-mechanical means for moving light bulbs about within the signal, so that a replacement bulb is moved into the place of a burnt bulb. However, it would be desirable to achieve these objectives without having to move light bulbs about within the signal.

SUMMARY OF THE INVENTION

The present invention provides for a light source having a plurality of light bulbs, in which, preferably, only one bulb is used at one time. When the bulb being used burns out, power is switched to another, operable bulb, and so on until all the bulbs have eventually burned out and require replacement. Thus, the signal is not rendered inoperative when a single light bulb burns out, and maintenance is not required until all the bulbs burn out.

The light bulbs do not move in relation to the lens system. Rather, a series of mirrors and lenses is provided so that a substantially identical pattern of light rays is emitted by the light source regardless of which bulb is being used.

The electric power switching process is controlled electrically or electronically. The switching system can also incorporate means to indicate which light bulb is being used.

For some applications, the light source may include or be used in association with a light guide to receive and transmit or to concentrate and change the direction of the light rays. This can also be accomplished by means of a system of mirror- or prism- type beam splitters.

The light source can also be used without the switching system, so that all the light bulbs are lit at the same time.

BRIEF DESCRIPTION OF THE DRAWINGS

In drawings which illustrate preferred embodiments of the invention.

DETAILED DESCRIPTION OF THE PREFERRED EMBODIMENTS

Figure 1:
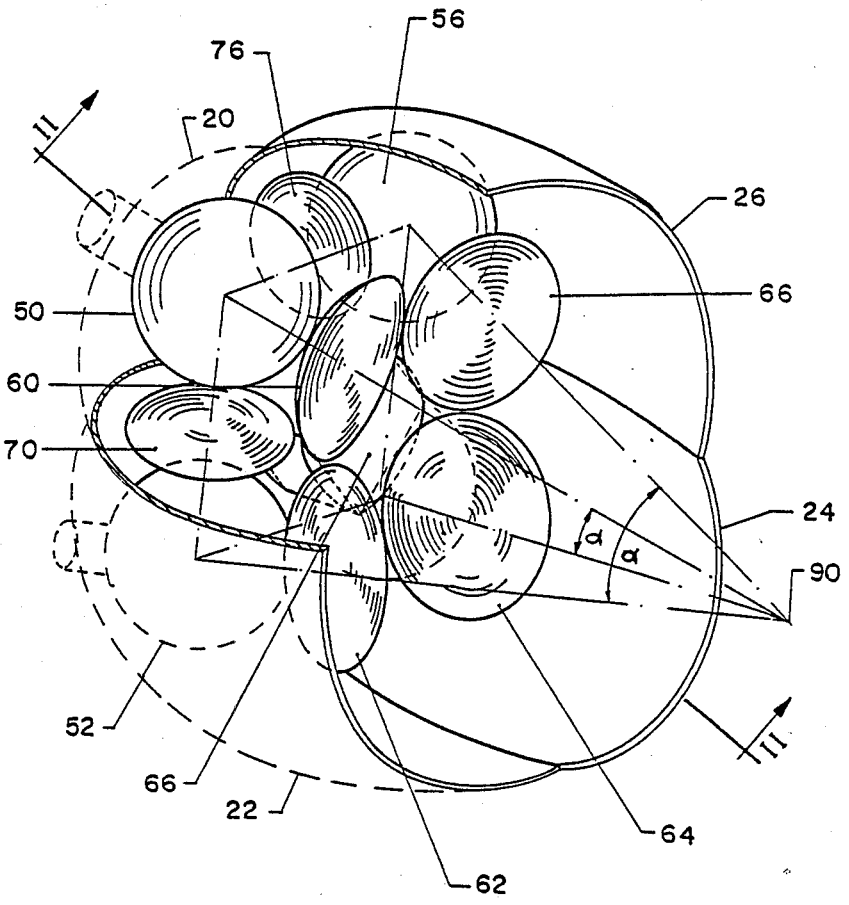
FIG. 1 is a partially cut-away, perspective view of the light source.
Figure 2:
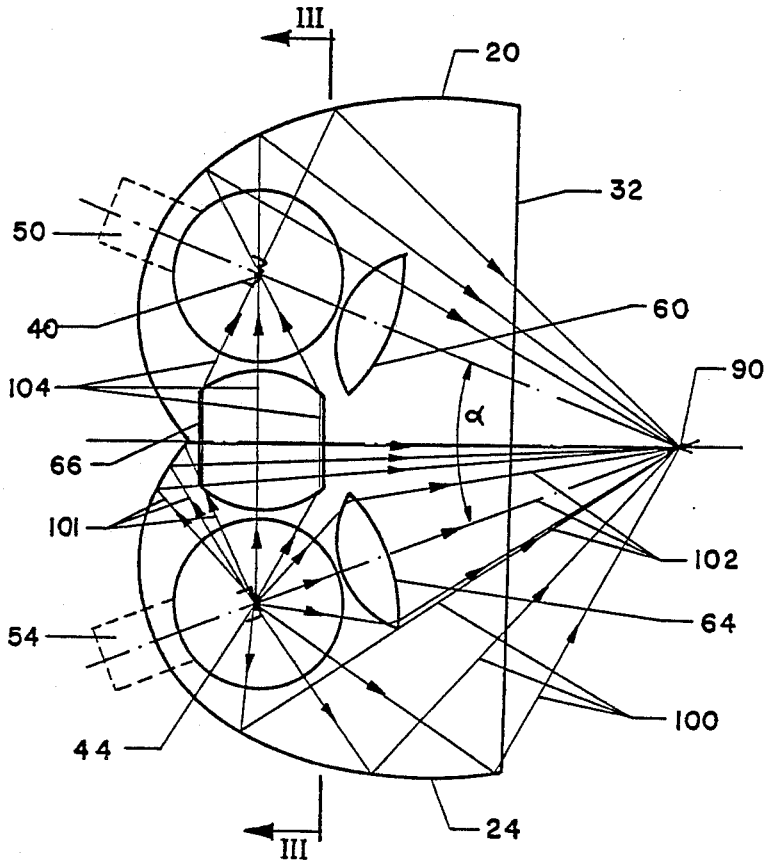
FIG. 2 is a longitudinal section through the light source along the line II—II of FIG. 1.
Figure 3:
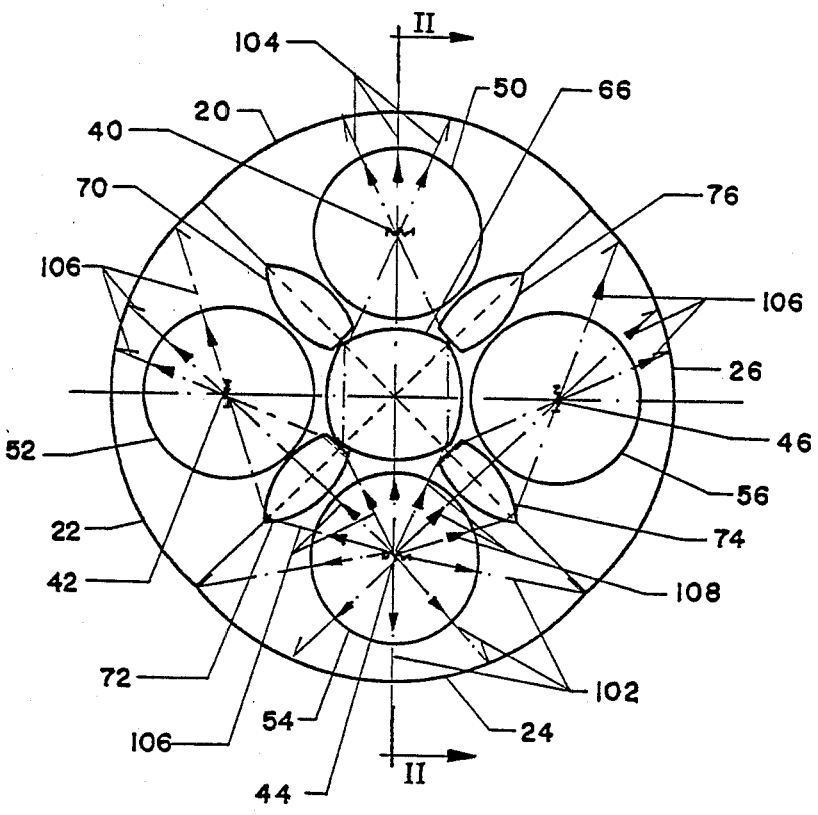
FIG. 3 is a section along the line III—III of FIG. 2.

In a preferred embodiment, illustrated in FIGS. 1, 2 and 3, the light source comprises four identical wedges of an ellipsoidal mirror 20, 22, 24 and 26 affixed together in a symmetrical manner. Mirrors 20, 22, 24 and 26 form a 360° concave mirror 32. The long axes of mirrors 20, 22, 24 and 26 are separated by an angle indicated as $\alpha$ in FIGS. 1 and 2. This angle can vary depending on the application of the light source, the type of mirrors used and space limitations in the signal in which the light source is employed. In the preferred embodiment, illustrated in FIG. 2, the angle $\alpha$ would be in the range of 30° to 60°.

Mirror 32 has four openings 34 in the back end to accommodate light bulbs 50, 52, 54 and 56. Light bulbs 50, 52, 54 and 56 contain filaments 40, 42, 44 and 46 respectively and project into the cavity of mirror 32.

Mirror 32, light bulbs 50, 52, 54 and 56 and the lenses enclosed by mirror 32, as described below, are collectively referred to herein as lamp 36.

Lenses are provided which cooperate with the light bulbs 50, 52, 54 and 56 and mirrors 20, 22, 24 and 26 to produce a uniform pattern of light emerging from the front end of the lamp 36, that is, at the right in FIG. 2. FIGS. 2 and 3 show the pattern of light rays produced by lamp 36 when light bulb 54 is lit. Light rays 100 and 101 are reflected by mirror 24 to focal point 90 in front of lamp 36. Light rays 102 pass through unsymmetrical double convex lens 64, which focuses light rays 102 at the same focal point 90. There are four identical unsymmetrical double convex lenses 60, 62, 64 and 66, adjacent each of light bulbs 50, 52, 54 and 56 respectively.

Light rays 104 pass through two-directional cubic lens 66 which focuses them at the filament of the light bulb opposite light bulb 54, namely, filament 40 of light bulb 50. Rays 104 are then reflected from and focused by mirror 20 to focal point 90.

Lamp 36 also contains four symmetrical double convex lenses 70, 72, 74 and 76 positioned between adjacent light bulbs, as shown in FIG. 3. It should be noted that for clarity of illustration, lenses 70, 72, 74 and 76 are not shown in FIG. 2, and lenses 60, 62, 64 and 66 are not shown in FIG. 3. Light rays 106 from bulb 54 pass through lens 72 which focuses them at filament 42 of light bulb 52. Rays 106 are then reflected from and focused by mirror 22 to focal point 90.

Likewise, rays 108 pass through lens 74 which focuses them at filament 46 of bulb 56. They are then reflected and focused by mirror 26 to focal point 90.

Rays 100, 101, 102, 104, 106 and 108 are the primary rays produced by lamp 36 when bulb 54 is lit and focused at focal point 90. Some incidental light rays, not shown in the drawings, will also be produced, primarily by reflection from mirror 32 and from the lenses in lamp 36. The light rays emitted by lamp 36, including both the primary and incidental rays, will form a characteristic pattern when bulb 54 is lit. It will be appreciated that the pattern will be identical whichever of bulbs 50, 52, 54 or 56 is lit. The pattern will simply be rotated from the pattern produced by bulb 54 by 90°, 180° or 270° respectively if bulb 52, 50 or 56 is lit.

This rotation of the pattern of light rays is immaterial for the applications for which the present invention is intended; the pattern of light rays emitted by lamp 36 when any one of the light bulbs is lit is therefore described as "identical" in this specification, notwithstanding this rotation of the pattern.

The reflecting and focusing of light rays to focal point 90 from bulbs 52, 50 and 56 is achieved in the same manner as that described above for bulb 54 by means of the mirrors and lenses that are in the same relative position to each of these bulbs that the mirrors and lenses discussed above are in relation to bulb 54. In this regard, it will be noted that the two-directional cubic lens 66 can transmit and focus light rays between the filaments of bulbs 52 and 56 as well as bulbs 54 and 50, as is evident from FIG. 3. Likewise, lenses 70, 72, 74 and 76 can transmit and focus light rays between filaments of bulbs 50 and 52, 52 and 54, 54 and 56, and 56 and 50 respectively.

Various alternative configurations of mirrors and lenses can be used to achieve the same result that is achieved by the light source illustrated in FIGS. 2 and 3. The geometry of the mirrors and the type and positions of the lenses depend on the particular requirements for the light source.

Figure 4:
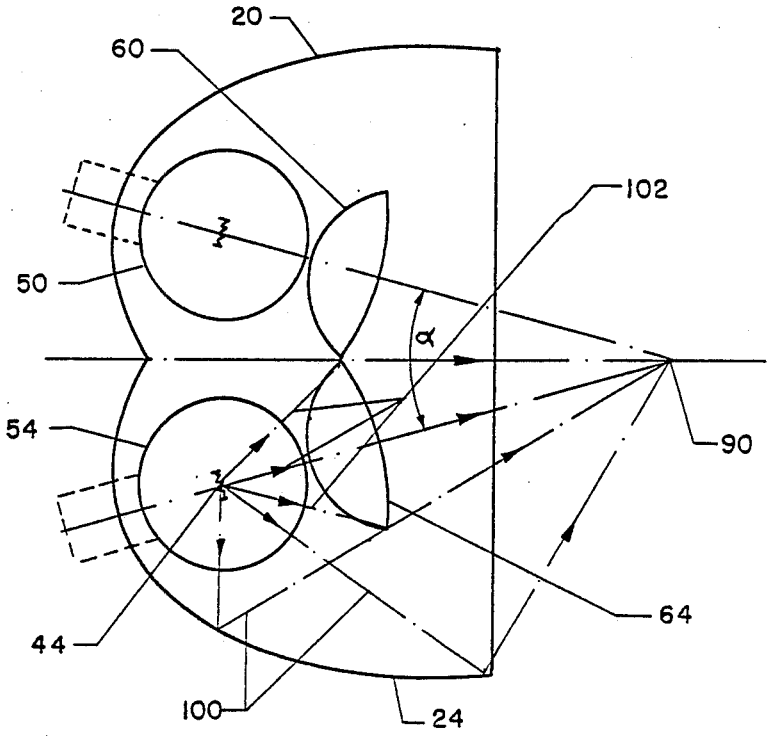
FIG. 4 is a longitudinal section through another embodiment of the device.

In the embodiment illustrated in FIG. 4, cubic lens 66 is omitted and lenses 60, 62, 64 and 66 contact each other. FIG. 3 shows the pattern of light rays produced when bulb 54 is lit.

Figure 5:
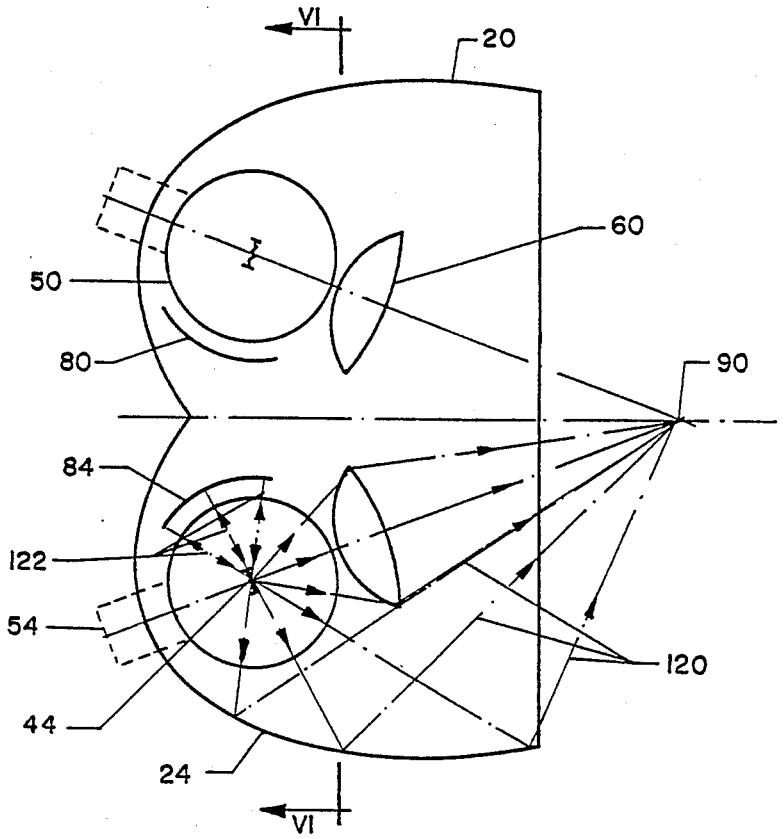
FIG. 5 is a longitudinal section through another embodiment of the device.
Figure 6:
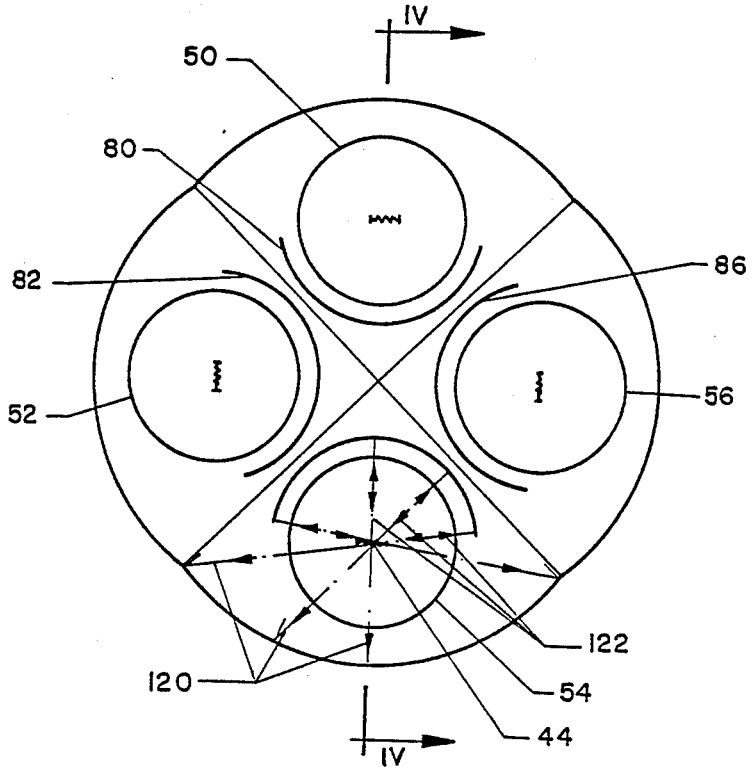
FIG. 6 is a section along the line VI—VI of FIG. 5.

The embodiment shown in FIGS. 5 and 6 omits cubic lens 66 but includes spherical mirrors 80, 82, 84 and 86. FIGS. 5 and 6 illustrate the pattern of light rays emitted from lamp 36 when bulb 54 is lit. Rays 120 are reflected and focused by mirror 24 to focal point 90. Rays 122 are reflected by mirror 84 and focused at filament 44. Rays 122 then merge with rays 120, being reflected by mirror 24 to focal point 90.

Figure 11:
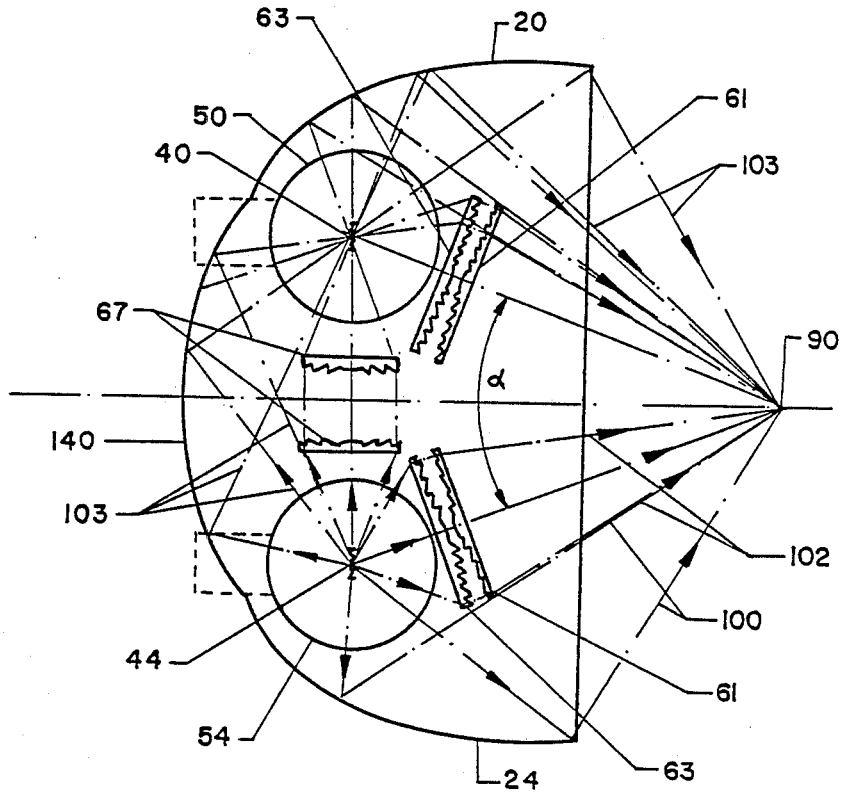
FIG. 11 is a longitudinal section through another embodiment of the light source.
Figure 12:
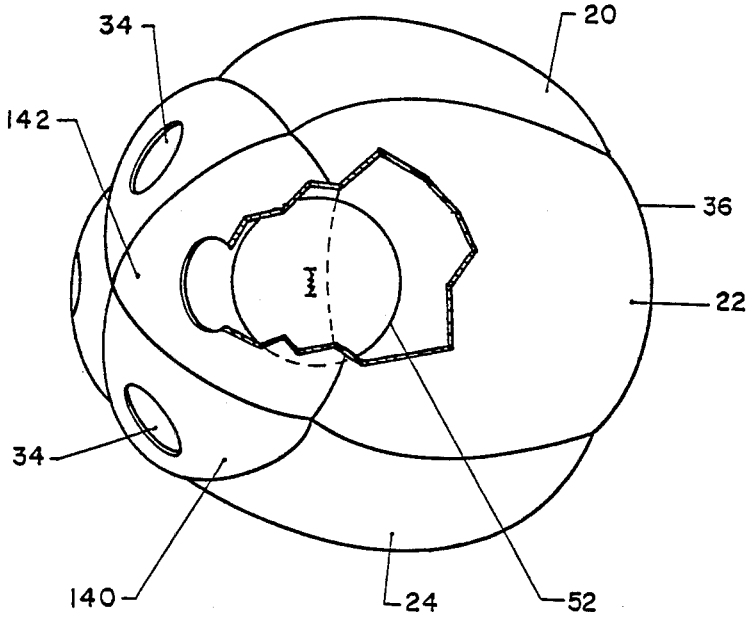
FIG. 12 is a perspective view from the rear of the embodiment shown in FIG. 11.

Two supplementary ellipsoidal mirrors are included in the embodiment illustrated in FIGS. 11 and 12. As shown in FIG. 12, ellipsoidal mirrors 140 and 142 intersect each other at the rear of lamp 36. The rear portions of mirrors 20, 22, 24 and 26 are removed to accommodate mirrors 140 and 142. The purpose of mirrors 140, 142 is to utilize light rays which shine on the rear of lamp 36 which would otherwise be wasted, and to reflect such rays to create a brighter and more balanced beam of light. This effect can be best seen by comparing FIGS. 2 and 11. In both Figures, bulb 54 is lit. In the embodiment shown in FIG. 2, a relatively narrow ray of light 101 is reflected from the rear portion of mirror 24 to focal point 90. In contrast, in the embodiment of FIG. 11, a relatively broad ray of light 103 from bulb 54 is reflected from mirror 140, is focussed at filament 40 of bulb 50 and is then reflected by mirror 20 to focal point 90. More light rays are therefore reflected by mirror 20 in the embodiment of FIG. 11 than in the embodiment of FIG. 2, producing a more balanced beam of light from lamp 36.

Fresnel lenses can be used to replace the various lenses discussed above. The use of Fresnel lenses is, for convenience, illustrated in FIG. 11, but it will be understood that they can be used in any of the embodiments discussed and have no particular connection with the use of supplementary ellipsoidal mirrors 140 and 142 which are shown in FIG. 11. Four Fresnel lenses 67 (of which only two are shown in FIG. 11) can replace cubic lens 66. Each of unsymmetrical double convex lenses 60, 62, 64 and 66 can be replaced by a pair of Fresnel lenses 61, 63, which have different focal lengths from each other, or by one Fresnel lens and one planar convex lens.

Likewise each of lenses 70, 72, 74 and 76 can be replaced by a pair of Fresnel lenses (not illustrated).

The preferred embodiments illustrated have ellipsoidal mirrors, because it is desired to focus the light rays emitted by the lamp at approximately a single point. This is because, as described in more detail below, the preferred embodiments are intended primarily for use in traffic control signals, in particular, railway traffic control signals, in which the light beam from lamp 36 must be passed through a relatively small colour filter. The preferred embodiments are adapted for use in conjunction with the existing optical systems of such signals. However, for other applications, other shapes of mirrors, such as parabolic, spherical or hyperbolic, could be utilized in order to produce the desired shape of light beam. For example, for a navigation buoy, spherical mirrors could be used in order to produce a wide-angle beam of light. The geometry and configuration of the mirrors and lenses required for such applications would be apparent to those skilled in the art, and lamps adapted for such purposes are intended to be within the scope of the present invention. It is apparent that when parabolic mirrors are used, the angle $\alpha$ is 0°, the axes of such mirrors being parallel.

The embodiments of lamp 36 described above all have four light bulbs and four main ellipsoidal mirrors (not including the supplementary mirrors shown in FIG. 11). However, fewer or more bulbs and mirrors can be used if desired. It is considered that embodiments having two mirrors and two bulbs or three mirrors and three bulbs would be preferred for certain applications, where it would be desirable to have a less expensive lamp and where a smaller number of backup bulbs was considered satisfactory. The configuration of two or three bulb lamps will be apparent in view of the description of the four bulb version. For example, in a two bulb lamp, mirrors 22 and 26 would be omitted and mirrors 20 and 24 would be extended to intersect each other. Lenses 62 and 66 and lenses 70, 72, 74 and 76 would be omitted. Cubic lens 66 can be replaced by two lenses (for example two of lenses 67 shown in FIG. 11) which would focus light between filaments 44 and 40. In a three-bulb lamp, cubic lens 66 is omitted. The use of supplementary ellipsoidal mirrors at the rear of the lamp would be preferred in embodiments having two or three bulbs.

Figure 7:
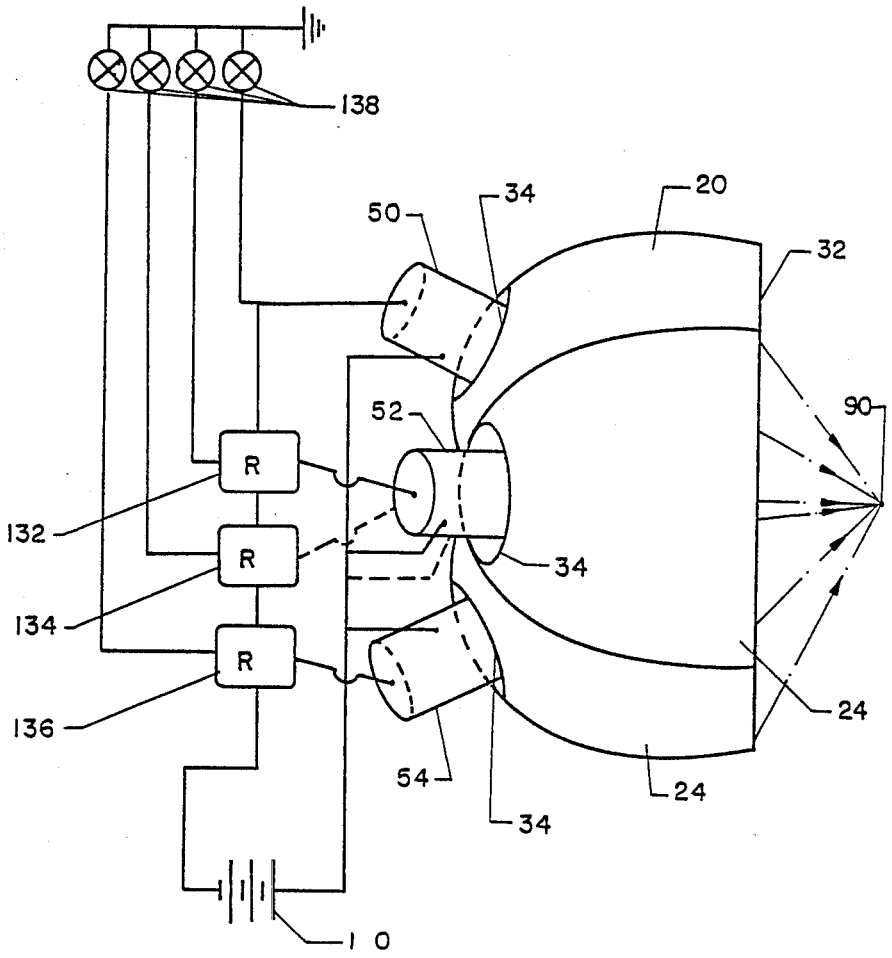
FIG. 7 is a perspective view of the light source according to the invention with a schematic illustration of the electronic switching system.

Considering now the means by which electric power is switched from one bulb to another, in a preferred embodiment, light bulbs 50, 52, 54 and 56 are controlled and actuated by an electronic switching system, which is illustrated schematically in FIG. 7. The purpose of the switching system is to switch power from one light bulb to another when the first one burns, and so on sequentially until all four light bulbs are burnt out and must be replaced.

The switching system comprises a power source 130, power relays 132, 134 and 136 and associated wiring, as shown in FIG. 7. Switching systems of the type illustrated are well known in the electronic engineering art. The switching system can include lighting diodes 138 to indicate which light bulb is in use, facilitating the replacement of burnt bulbs by maintenance workers before all four bulbs fail, if desired. Other types of switching and indicating systems can be selected, depending upon the application.

Although the preferred embodiments include a power switching system, it is also possible to use lamp 36 without a switching system. In this case, all four light bulbs would be lit at the same time. Then, when one burnt out, only three would be lit, and so on until all the bulbs burnt out. The intensity of the light emitted from lamp 36 would, of course, decrease as each bulb burnt out, though it is possible to use a current control system to keep constant the intensity of the light emitted.

Figure 8:
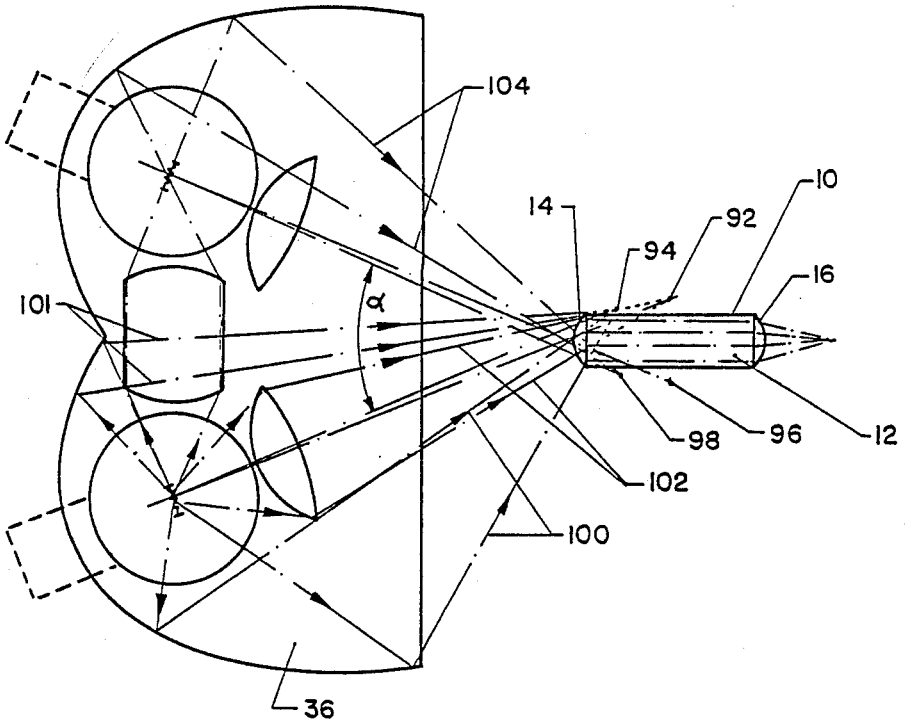
FIG. 8 is a longitudinal section through an embodiment with a light guide.

FIG. 8 illustrates lamp 36 used in association with light guide 10. In FIG. 8, lamp 36 is the embodiment of FIG. 2, but light guide 10 can be used in association with any of the embodiments of the invention which focus light towards a point or small area.

Figure 9:
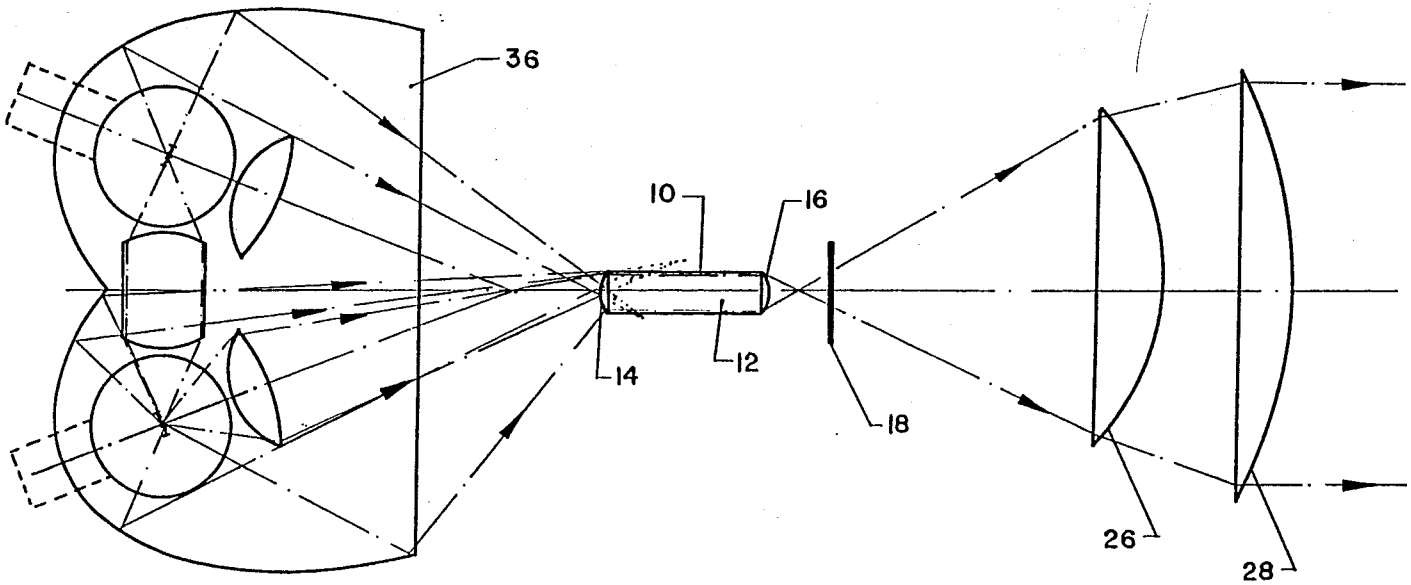
FIG. 9 is a longitudinal section of the embodiment shown in FIG. 8 in association with the optical system of a railway signal.

Light guide 10 comprises fibre optic bundle 12 and lenses 14 and 16. The type of lenses, and the length and diameter of the fibre optic bundle are determined by the requirements of the installation. FIG. 9 shows lamp 36 with light guide 10 in conjunction with a railway signal. The optical system of the railway signal includes colour filter 18 and lenses 26 and 28. Here, light guide 10 directs the beam of light emitted by lamp 36 to colour filter 18.

Figure 10:
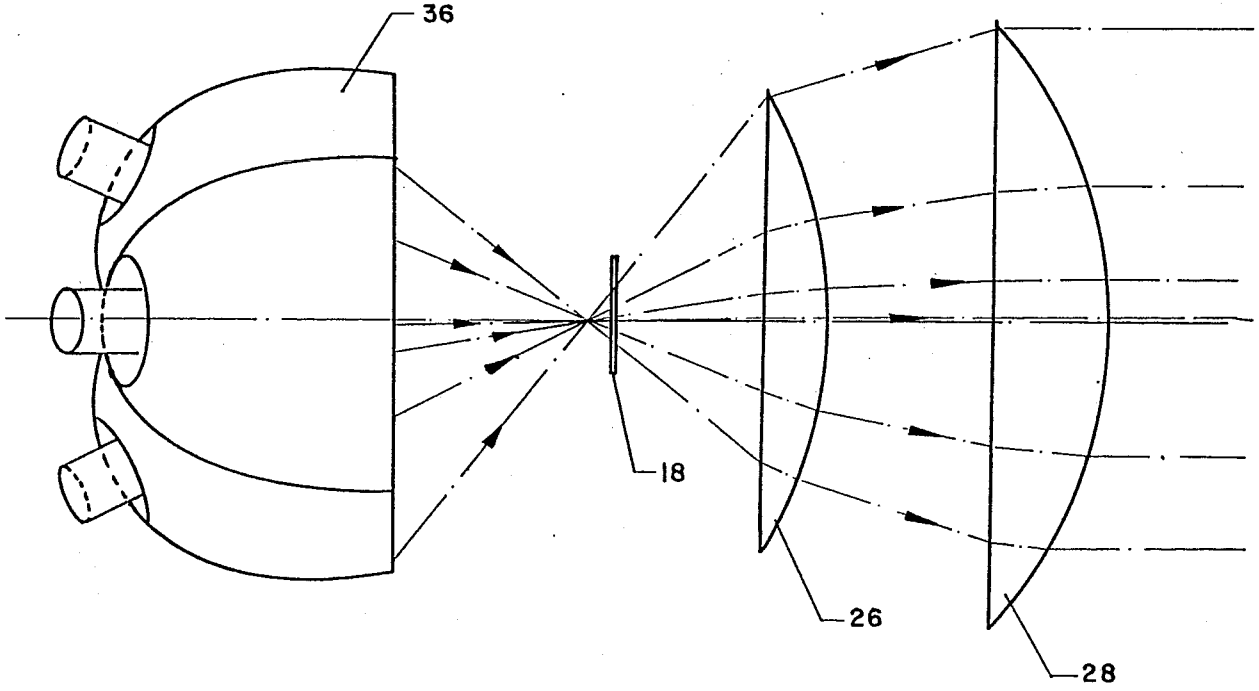
FIG. 10 is a perspective view of the light source in association with the optical system of a railway system.

The light source according to the invention can also be used in conjunction with a railway signal without light guide 10. This is illustrated in FIG. 10.

Where light guide 10 is used, it is desirable to focus the light rays from lamp 36 across lens 14 of light guide 10, rather than at a single point. This can be achieved by focusing light rays 102 at focal point 92 and light rays 100 at focal point 94, as shown in FIG. 8. The corresponding focal points when light bulb 50 is operated are indicated at points 96 and 98. The corresponding focal points when light bulbs 52 and 56 are lit are not illustrated in the drawings.

It will be understood that many modifications may be made to the invention without departing from the spirit and substance thereof.

What is claimed is:

1. An optical device for directing the light rays from a plurality of light bulbs, for use in association with means for directing an electric current to each of said light bulbs, one at a time, and for switching said electric current from a light bulb when it burns out to another, operable one of said light bulbs, until all of said light bulbs are burnt out, said device comprising:

(a) a concave mirror comprising a plurality of wedges of ellipsoidal mirrors;

(b) means for holding said light bulbs within the concavity of said concave mirror; and (c) means for focusing light rays from each of said light bulbs to produce a substantially identical pattern of light rays emitting from said device to a common focal area regardless of which one of said light bulbs is lit.

2. A device according to claim 1, wherein said focusing means comprises a plurality of lenses disposed within the concavity of said concave mirror.

3. A device according to claim 2, wherein said plurality of lenses comprises a plurality of unsymmetrical double convex lenses, disposed one adjacent each of said light bulbs.

4. A device according to claim 2, wherein said plurality of lenses comprises a plurality of spherical mirrors disposed one adjacent each of said light bulbs.

5. A device according to claim 2, wherein said plurality of lenses comprises a plurality of pairs of Fresnel lenses, disposed one pair adjacent each light bulb.

6. A device according to claim 2, wherein said plurality of lenses comprises a plurality of pairs of lenses, one of each pair being a Fresnel lens and one of each pair being a planar convex lens, disposed one pair adjacent each light bulb.

7. A device according to claim 2, wherein said plurality of lenses comprises a plurality of pairs of Fresnel lenses disposed one pair between each pair of adjacent light bulbs.

8. A device according to claim 2, wherein said plurality of lenses comprises a plurality of symmetrical double convex lenses, one disposed between each pair adjacent light bulbs.

9. A device according to claim 2 wherein the number of light bulbs is four, and wherein the plurality of lenses further comprises a two-directional cubic lens disposed between said four light bulbs.

10. A device according to claim 2 wherein the number of light bulbs is four and wherein the plurality of lenses further comprises two pairs of Fresnel lenses, disposed one pair of Fresnel lenses between each pair of opposite light bulbs.

11. A device according to claim 2 further comprising means to receive and transmit light rays emitted by said device.

12. A device according to claim 11 wherein said light receiving and transmitting means is a light guide.

13. An optical device for directing the light rays from a plurality of light bulbs, for use in association with means for directing an electric current to each of said light bulbs, one at a time, and for switching said electric current from a light bulb when it burns out to another, operable one of said light bulbs, until all of said light bulbs are burnt out, said device comprising:

(a) a concave mirror comprising a plurality of wedges of mirrors selected from the group comprising parabolic, spherical and hyperbolic mirrors;

(b) means for holding said light bulbs within the concavity of said concave mirror; and (c) means for focusing light rays from each of said light bulbs to produce a substantially identical pattern of light rays emitting from said device to a common focal area regardless of which one of said light bulbs is lit.

14. A device according to claim 13 wherein said focussing means comprises a plurality of lenses disposed within the concavity of said concave mirror.

* * * * *